US006388647B2

(12) United States Patent
Leung et al.

(10) Patent No.: US 6,388,647 B2
(45) **Date of Patent: *May 14, 2002**

(54) INCREASING THE NUMBER OF COLORS OUTPUT BY A PASSIVE LIQUID CRYSTAL DISPLAY

(75) Inventors: Charles Leung; Keith Lee, both of Markham (CA)

(73) Assignee: ATI Technologies, Inc., Ontario (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/811,649

(22) Filed: Mar. 5, 1997

(51) Int. Cl.[7] ..... G09G 3/36
(52) U.S. Cl. ..... 345/88; 345/89
(58) Field of Search ..... 345/88, 87, 89, 345/152, 147, 148, 149

(56) References Cited

U.S. PATENT DOCUMENTS 4,675,831 A * 6/1987 Ito et al. ..... 364/518
4,688,031 A * 8/1987 Haggerty ..... 345/149
4,827,255 A * 5/1989 Ishii ..... 345/148
5,023,603 A * 6/1991 Wakimoto et al. ..... 345/148
5,189,409 A * 2/1993 Mano et al. ..... 345/88
5,293,159 A * 3/1994 Basseti, Jr. et al. ..... 345/149
5,298,915 A * 3/1994 Basseti, Jr. ..... 345/149
5,400,044 A * 3/1995 Thomas ..... 345/147
5,552,800 A * 9/1996 Uchikoga et al. ..... 345/89
5,585,950 A * 12/1996 Nishino et al. ..... 345/88
5,657,043 A * 8/1997 Fukui et al. ..... 345/100
6,072,451 A * 6/2000 Mano et al. ..... 345/89

FOREIGN PATENT DOCUMENTS

JP 60053373 * 3/1985

* cited by examiner

*Primary Examiner*—Richard Hjerpe
*Assistant Examiner*—Ronald Laneau
(74) *Attorney, Agent, or Firm*—Vedder, Price, Kaufman & Kammholz

(57) ABSTRACT

A technique to increase the number of colors output by a passive color LCD display provides an increased number of grey levels for each pixel component. An M×N matrix pattern of pixel components is generated having a ratio of pixel components that are ON to the total number of pixel components to achieve a particular grey level on the passive color LCD screen, where M and N are greater or equal to two. The M×N matrix pattern is repeated for X frames, and at least one pixel component is ON in each frame. At the end of the Xth frame, the first matrix pattern for frame zero is repeated.

10 Claims, 7 Drawing Sheets

GREY LEVEL 2 (COMPLEMENT TO GREY LEVEL 13)

GREY LEVEL 3 (COMPLEMENT TO GREY LEVEL 12)

GREY LEVEL 4 (COMPLEMENT TO GREY LEVEL 10)

GREY LEVEL 7

GREY LEVEL 5 (COMPLEMENT TO GREY LEVEL 9)

GREY LEVEL II

GREY LEVEL III

INCREASING THE NUMBER OF COLORS OUTPUT BY A PASSIVE LIQUID CRYSTAL DISPLAY

CROSS-REFERENCE TO RELATED APPLICATIONS

The present application is related to co-pending, commonly assigned U.S patent application Ser. No. 08/811,866, entitled "Increasing the Number of Colors Output by an Active Liquid Crystal Display" and filed Mar. 5, 1997.

BACKGROUND OF THE INVENTION

The invention relates to a technique and device for increasing the number of colors output by a passive liquid crystal display.

Passive color liquid crystal (LCD) displays are commonly known as STN or DSTN panel displays, and are commonly used in laptop computers to present information to a user. Passive color LCD panels are similar to color cathode-ray tube (CRT) monitors in that the resolution depends upon the number of pixels in the display. Typical resolutions are 640 columns of pixels by 480 rows of pixels (640×480), 800×600 pixels and 1024×768 pixels. However, the CRT monitor uses analog data to form images on its screen, while a passive color LCD panel displays uses digital data.

Each pixel consists of three primary color components: red, green and blue. Consequently, passive color LCD displays are capable of displaying eight colors: white, black, red, green, blue, magenta, cyan and yellow. The colors are created by generating digital data that controls the ON and OFF state of each color component of the pixels on the screen. For example, if a digital 111 signal is supplied to every pixel then all three color components for each pixel are ON, and the display screen will appear white in color to the human eye. However, a digital 000 signal supplied to every pixel turns all of the color components OFF and the display screen appears black in color. If a digital 100 signal is supplied to all pixels, then the red components are ON and the blue and green components are OFF so that the screen appears red in color. Thus, by controlling the combinations of color components which are ON and OFF for each pixel, the eight colors identified above can be generated.

New data must be supplied to the pixels of a passive color LCD display periodically to refresh the image shown on the screen, and such time segments are known as frames. Three bits of data per pixel is typically supplied every 1/60th of a second, which corresponds to a refresh rate of sixty frames per second.

Since each color component in the above example can only be turned ON or OFF, the grey level for each color component is two. In order to increase the number of grey levels and thus the number of colors that can be displayed, some prior art passive color LCD panels use a technique known as frame modulation. Using such a technique, some manufacturers claim that their passive LCD displays are capable of displaying as many as 256 colors. However, there is a need for not only increasing the number of colors that may be displayed by a passive color LCD display, but also for improving the overall quality of the color and for minimizing any flicker of the screen which can be detected by the human eye.

SUMMARY OF THE INVENTION

The invention increases the number of colors output by a passive liquid crystal display by providing an increased number of grey levels.

In general, the invention features generating a M×N matrix pattern of pixel components on the display having a ratio of pixel components that are ON to the total number of pixel components to achieve a particular grey level, wherein M and N are greater or equal to two. The M×N matrix pattern is produced for X frames, wherein at least one pixel component is ON in each frame.

Preferred embodiments include the following features. In the M×N matrix pattern the same number of pixel components are ON in each frame but in different locations. In addition, at least one of the pixel components is ON in each row and column in each frame. Further, over the course of X frames, each pixel component is turned ON for "Y" amount of times, wherein "Y" equals the number of pixel components in each row or column that is ON in any one frame. Yet further, the M, N and X variables are all equal, so that a square dimension matrix is generated which is repeated for the same number of frames as the dimension. Additionally, the value of X is chosen so that the number of frame cycles of a particular grey level matrix pattern is not a multiple of the frame cycle of another grey level matrix pattern. A plurality of grey level matrix patterns are generated having an average brightness that varies over the full range of a pixel component, and preferably 16 grey level matrix patterns are utilized. The average brightness level of at least some of the 16 grey level matrix patterns is not an increment of 16.

In another aspect of the invention, preferred embodiments include square-dimension matrix patterns to produce sixteen grey levels. In particular, 17×17 matrix patterns are described having two pixel components ON in each row or column to generate grey level 1, twelve pixel components ON in each row or column to generate grey level 11, and fifteen pixel components ON to generate grey level 14. Also, 5×5 matrix patterns are described having one pixel component ON in each row or column to generate grey level 2, two pixel components ON in each row or column to generate grey level 5, three pixel components ON in each row or column to generate grey level 9, and four pixel components ON in each row and column to generate grey level 13. Two 4×4 matrix patterns are described having one pixel component ON in each row and column to generate grey level 3, and three pixel components ON in each row or column to generate grey level 12. Similarly, two 3×3 matrix patterns are disclosed having one and two pixel components ON in each row and column, to generate grey levels 4 and 10, respectively. A 2×2 matrix pattern with one pixel component ON in each row is used to generate grey level 7, and two 7×7 matrix patterns are described having three and four pixel components ON to generate grey level 6 and grey level 8, respectively.

In a further aspect of the invention, a grey level generator to produce the matrix patterns according to the invention is described. In particular, a memory is provided for storing M×N matrix data, in addition to a frame counter for counting to X frames, a column counter for counting to N, and a row counter for counting to M. The row counter is pre-loaded with a value for a pixel component at the beginning of each frame based on the data stored in memory. A comparator generates an output signal to the passive LCD display indicating which pixel components should be ON or OFF depending on the frame and their row and column location.

DESCRIPTION OF THE PREFERRED EMBODIMENTS

Figure 1:
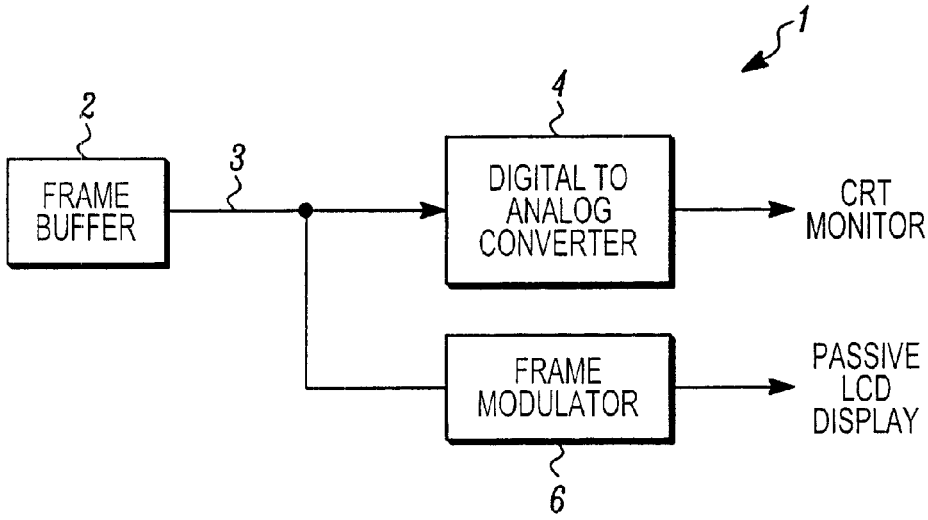
FIG. 1 is a simplified block diagram of several of the components of a graphics controller semiconductor chip for controlling display screen colors.

FIG. 1 is a simplified, partial block diagram 1 of several of the components of a graphics controller semiconductor chip for generating the signals used to control the screen colors of a passive color LCD display or a cathode-ray tube (CRT) display. A frame buffer 2 stores the data required for each color component of each pixel of a display screen. The data provided depends on the color to be displayed at a particular location on the screen and at a particular time. The output signal 3 of the frame buffer 2 is received by a digital-to-analog convertor 4 for producing analog signals for use by a CRT monitor, and by a frame modulator 6 for producing digital signals for use by a passive color LCD display screen. Since data may be required for an analog CRT monitor, the frame buffer 2 stores 24 bits of data for each pixel. For a typical screen refresh rate of 60 frames per second, each pixel on the passive color LCD display screen requires three bits of data every 1/60th of a second. Therefore, the frame modulator 6 produces a three bit signal for each pixel on the passive color LCD screen, which is explained in detail below.

Since each pixel is comprised of three color components, and since each component can either be ON or OFF, the most basic technique for generating colors on the LCD screen produces only 8 colors having only two grey levels. However, by using frame modulation, an increased number of grey levels are generated which increases the number of colors that can be displayed. The present technique generates sixteen grey levels so that instead of 8 colors, the passive LCD screen is capable of displaying 4,096 colors.

Figure 2:
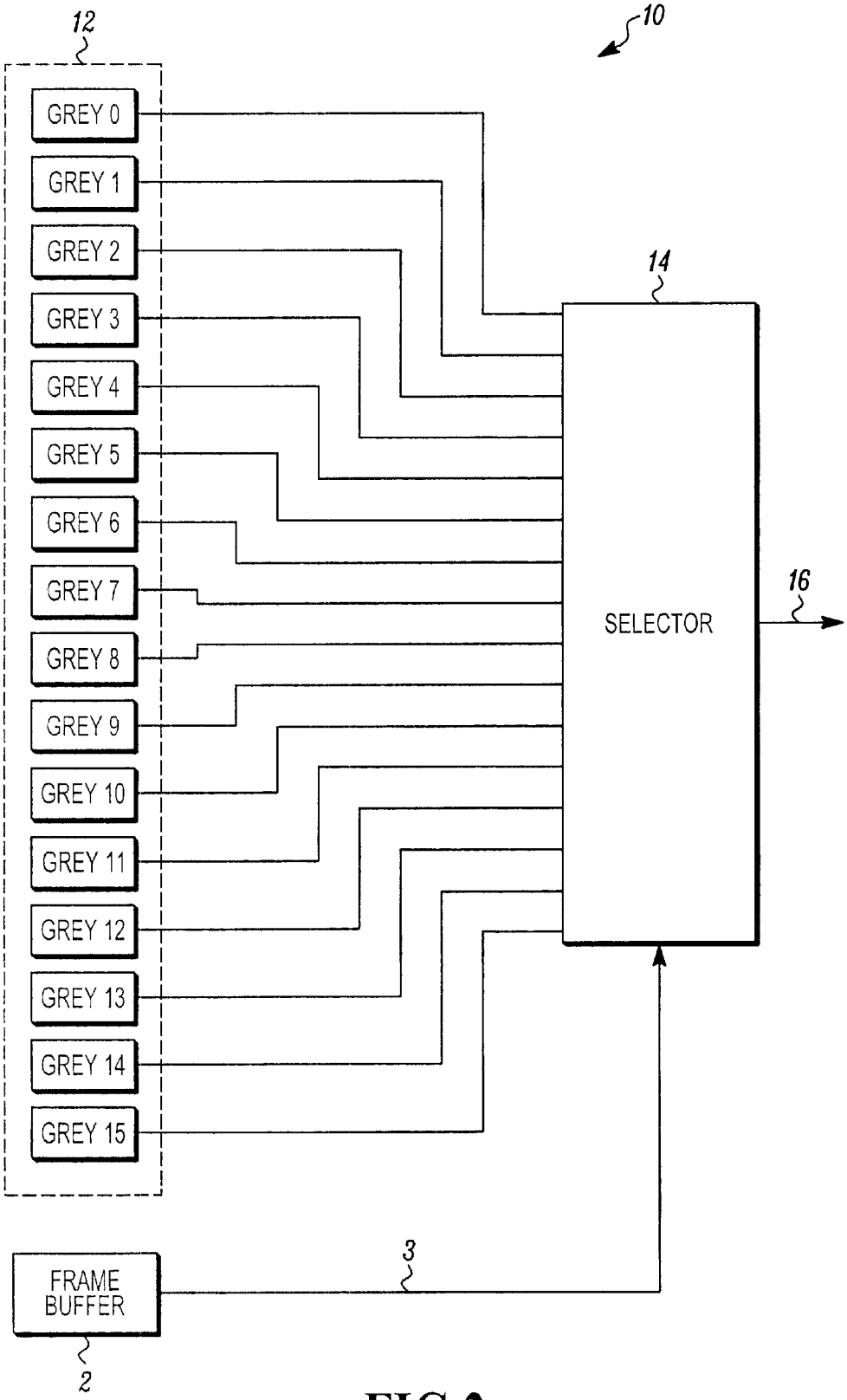
FIG. 2 is a simplified block diagram illustrating an implementation of the invention.

FIG. 2 is a simplified block diagram 10 illustrating an implementation of the technique. Sixteen grey level pattern generators are shown within the dotted line 12 labelled "grey 0" to "grey 15". Each grey level pattern generator produces a unique matrix pattern of signals which can be selected by the selector 14 to output a particular grey level signal 16 for a passive color LCD panel. The selector 14 utilizes the four most-significant bits of the 24-bit output signal 3 from the frame buffer 2 to choose which one of the sixteen grey level generators to use.

FIGS. 3A–3J depict preferred embodiments of M×N matrix patterns for use in generating grey levels for one color component of the pixels of a passive color LCD display. A black dot indicates the ON state of a color component of a pixel at that coordinate or location in the matrix, and a blank or white dot indicates the OFF state of that color component of a pixel at that coordinate.

The same matrix patterns shown in FIGS. 3A–3J are used for each of the three color components of the pixels to generate their grey levels. Grey levels 0 and 15 are not shown, because grey level 0 corresponds to each color component of each pixel being OFF (for the color black), and grey level 15 corresponds to each color component of each pixel being ON (for the color white).

Each grey level M×N matrix pattern is produced by one of the grey level pattern generators 12 shown in FIG. 2. In addition, it should be understood that matrix patterns of different dimensions than those shown in FIGS. 3A–3J and that are not necessarily square are contemplated, and that different combinations of pixels in the ON or OFF states could also be used. For example, rectangular M×N matrix patterns could be used.

The grey level matrix patterns of FIGS. 3A–3J can be stored in a look-up table in a memory. When required, the grey level patterns may be utilized over any particular section or sections of the passive color LCD display screen for any of the colors as needed. For example, portions of a passive display LCD screen requiring a certain color may be supplied with the frame modulation patterns of FIG. 3A, while at the same time other portions of the screen display different colors using other grey level matrix patterns.

Figure 3A:
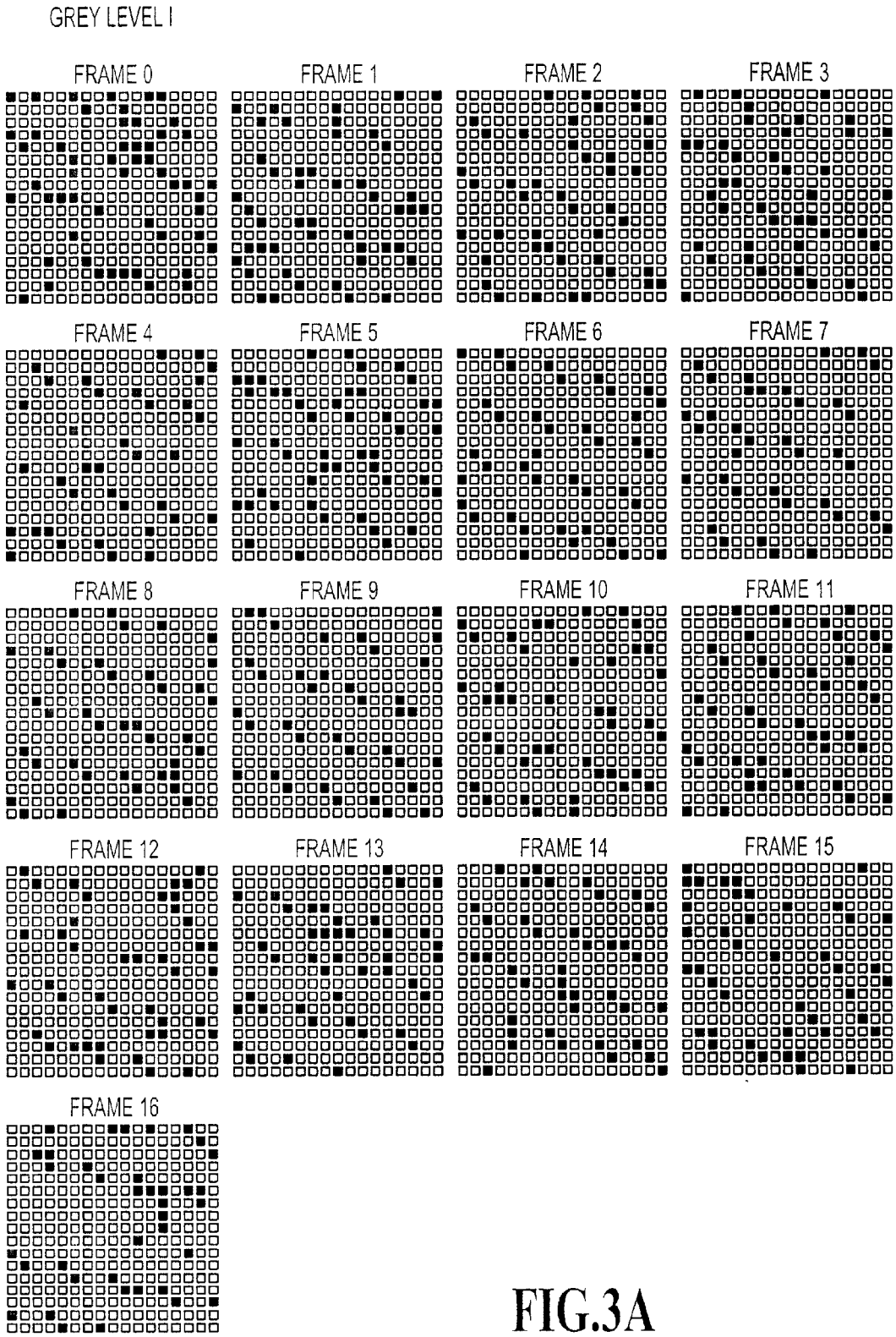
FIGS. 3A–3J illustrate preferred embodiments of N—N matrix patterns for generating grey levels according to the invention.

FIG. 3A depicts a 17×17 pixel matrix pattern which changes over the course of 17 frames, which is used to produce grey level 1 for a color component on the passive color LCD display. The 17×17 matrix pattern can be regarded as the output of a four-dimensional function pertaining to a component of each pixel on the screen. The inputs to the function are the x and y coordinates of the pixels, the particular grey level required, and the current frame number which changes with time. For example, if an entire 640×480 pixel passive color LCD display is to be grey level 1 for a color component, then the 17×17 matrix pattern of frame zero would be replicated to cover the entire screen, and when the screen is refreshed then the matrix pattern of frame one is used, and so forth for 17 frames. After the 17th frame, the matrix pattern of frame zero is then repeated if grey level 1 is still required. In addition, even if only a small portion of the screen which is less than 17 pixels on a side is required to be grey level 1, the matrix pattern of FIG. 3A is generated and a portion reproduced in that area for 17 frame cycles. Since the grey level pattern is averaged over 17 cycles, that portion of the screen will appear to be at the correct grey level color to the human eye.

Referring again to FIG. 3A, two pixel color components are ON in each of the seventeen rows and seventeen columns for each of the 17 frames, and each frame is visible on the display screen for 1/60th of a second (assuming a refresh rate of 60 frames per second). Furthermore, each pixel in the 17×17 matrix pattern will be turned ON twice every 17 frames. The 17×17 matrix may be used on any portion of the screen, and a user observing the passive color LCD panel will see a color brightness averaging 2/17 or 0.11 of the full (white) brightness capability in the area of the screen for grey level 1.

As shown in FIG. 3A, care has been taken to ensure that for each frame at least two blank pixels separate the two pixels that are ON in each row, and that at least five blank pixels separate the two pixels that are ON in each column. The distribution of pixel color components that are ON to those that are OFF in grey level 1 ensures that an observer will see an even color output on the passive color LCD screen.

Figure 3B:
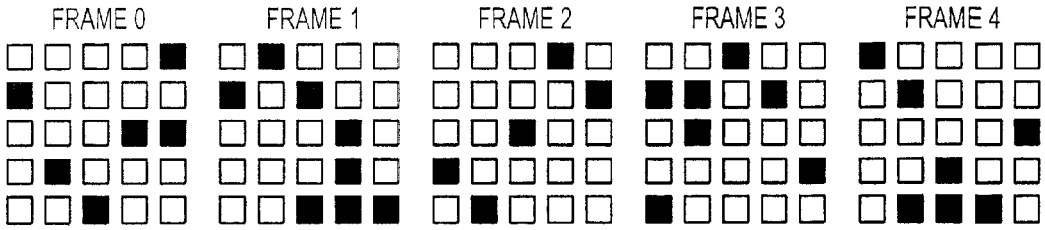
Figure 3C:
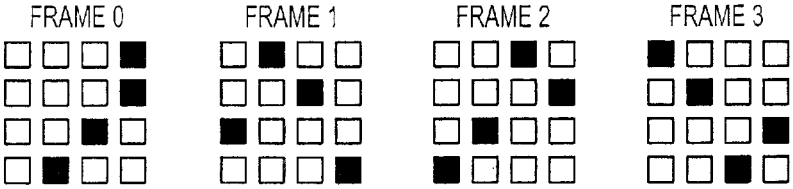
Figure 3D:
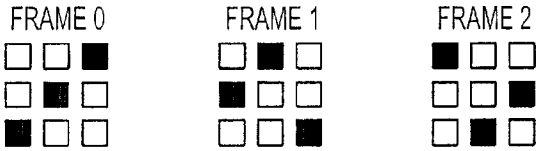
Figure 3G:
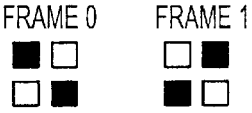
Figure 3E:
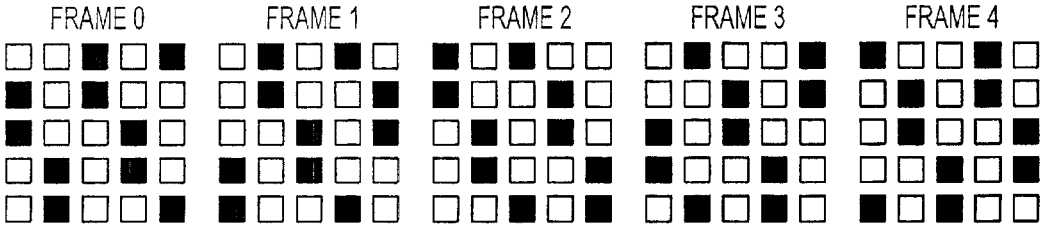
Figure 3F:
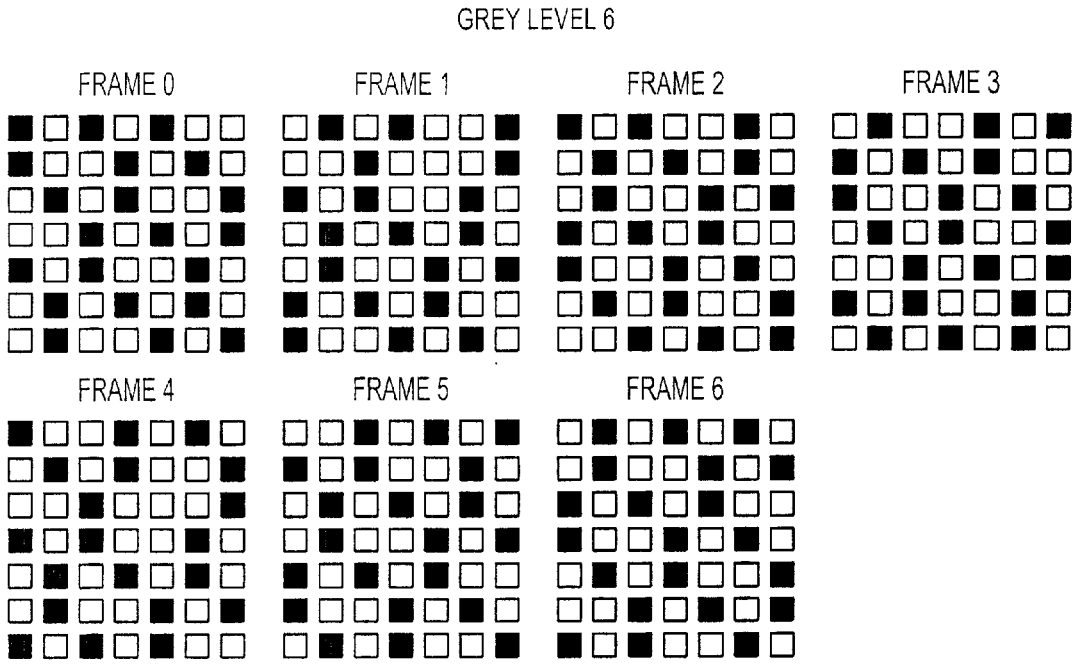
Figure 3H:
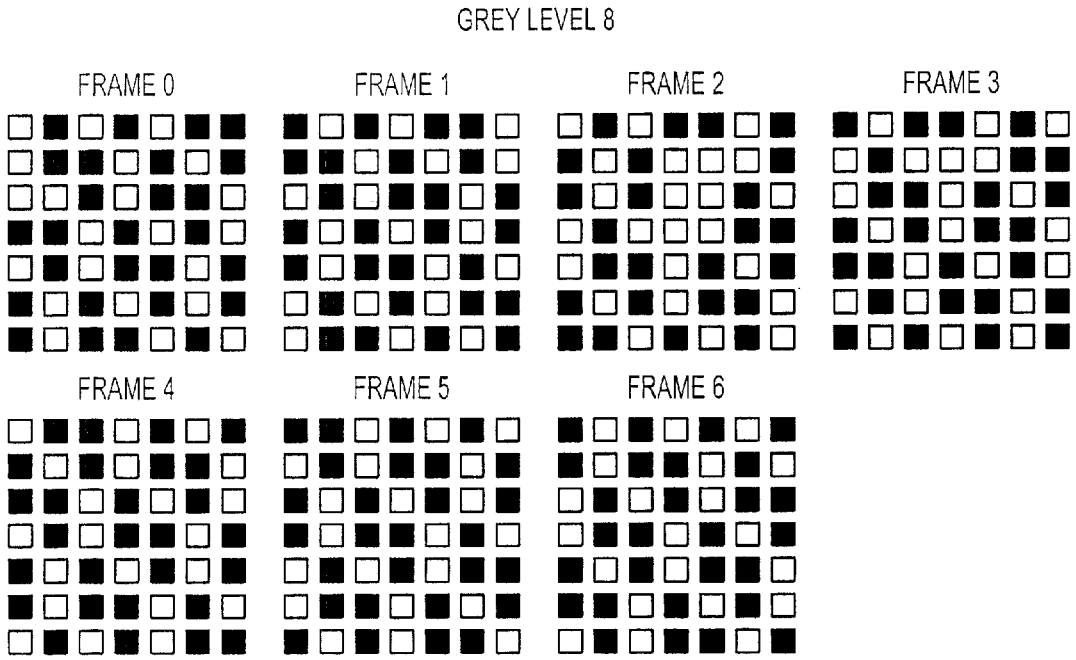
Figure 3I:
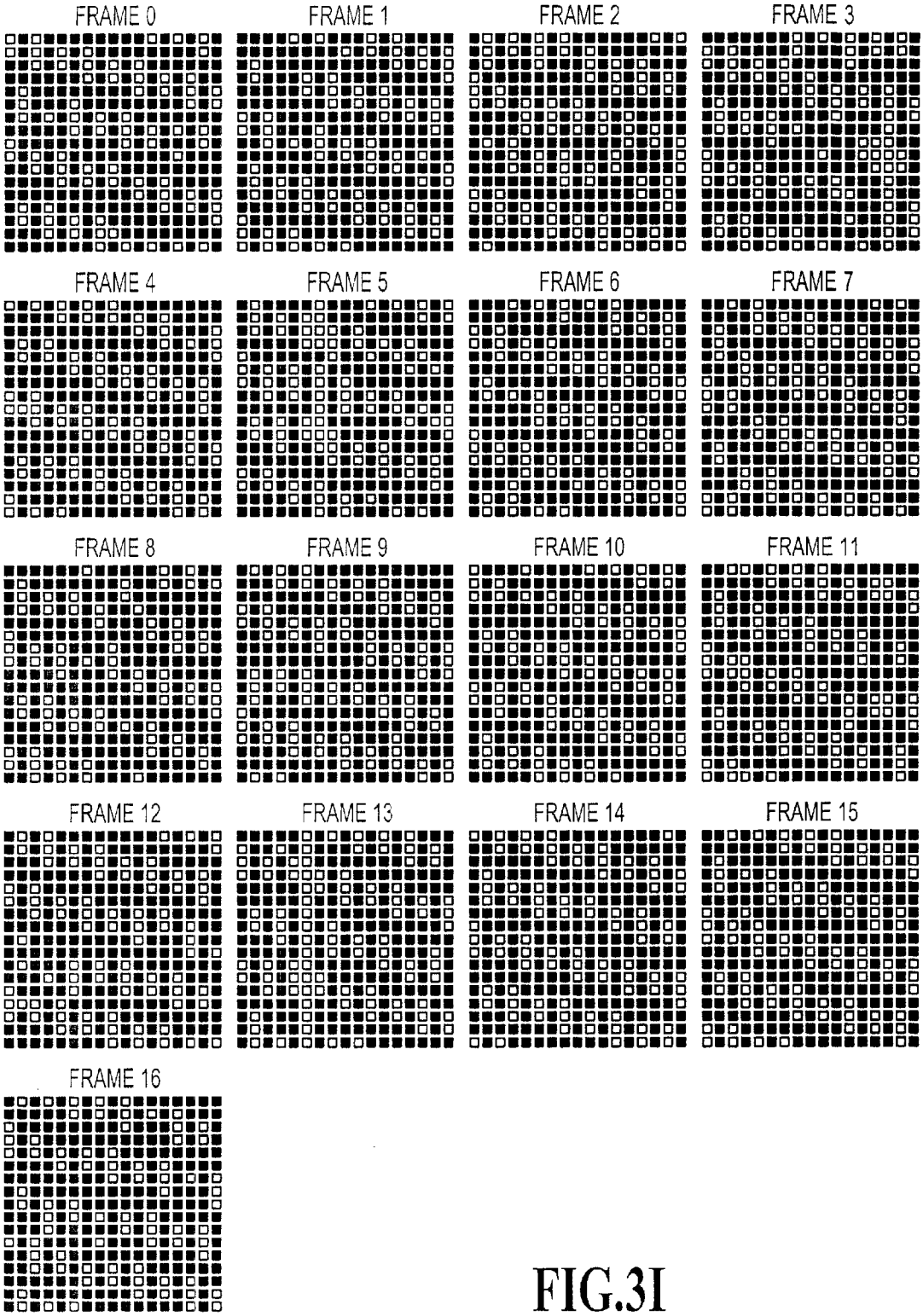
Figure 3J:
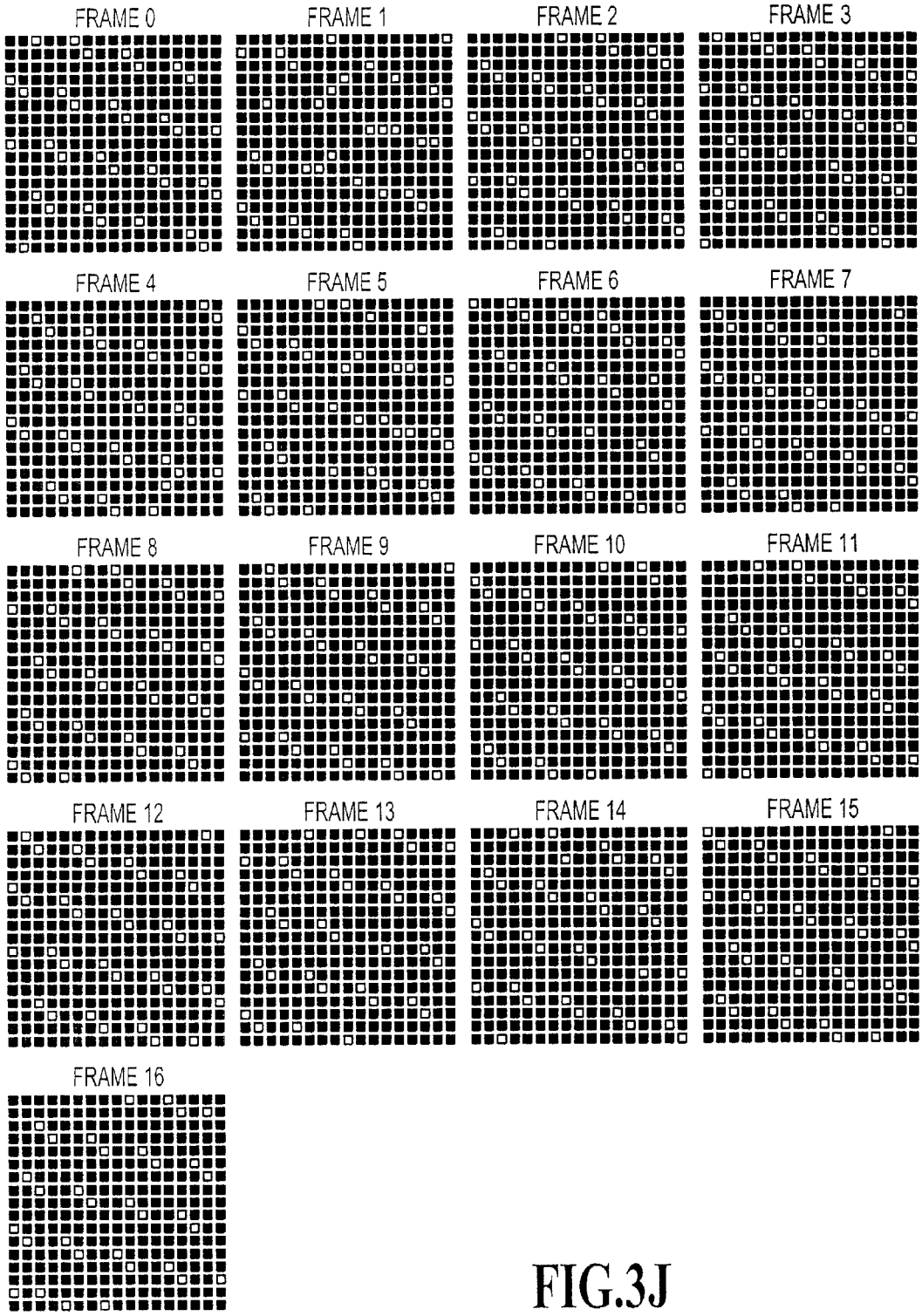

Referring now to FIG. 3J, the 17×17 pattern matrix for grey level 14 is shown, which is the complement of the 17×17 pattern matrix for grey level 1. Consequently, only two pixel color components are OFF in each of the seventeen rows and seventeen columns for each of the 17 frames. For grey level 14, care has been taken to ensure that at least two pixels color components that are ON separate the two OFF components in each row, and that at least five that are ON separate the two that are OFF in each column. An observer looking at the passive color LCD display of grey level 14 will see a color output averaging 15/17 or 0.88 of the brightness capability of the passive color LCD screen.

FIGS. 3B–3D depict the matrix patterns generated for grey levels 2, 3 and 4, respectively. Again, care has been taken to evenly distribute the components that are ON with regard to those that are OFF, and there is only one pixel component ON in any one row or column. The matrix dimensions differ for each of these grey levels, and grey level 2 is the complement of grey level 13, grey level 3 is the complement of grey level 12, and grey level 4 is the complement of grey level 10. This means that grey levels 13, 12 and 10 utilize the same dimension matrix patterns as grey levels 2, 3 and 4, respectively, except that only one pixel component is OFF in any one row or column.

FIG. 3E depicts the matrix pattern for grey level 5, which is the complement to grey level 9. In the 5×5 pixel matrix pattern of grey level 5, two pixels are ON in every row and in every column. Care has also been taken here to ensure that at least one blank pixel in each row separates the two pixels that are ON, however, the pixels that are ON in each column are either neighbors or are on the opposite edges of the matrix, as shown.

FIG. 3F illustrates the preferred 7×7 matrix pattern utilized for grey level 6, wherein three pixels are ON for each row and column. In each row, at least one blank pixel component separates those that are ON, and in each column no more than two adjacent pixel components may be ON. In addition, in each column two blank components separate the neighboring components that are ON from the third pixel component that is ON. The 7×7 matrix pattern for grey level 6 is the complement of the 7×7 matrix pattern for grey level 8, which is shown in FIG. 3H. In particular, for grey level 8 four pixel components are ON in each row and column.

Grey level 7 is shown in FIG. 3G, which falls in the middle of the color grey level scale. Consequently, a 2×2 pattern matrix is used wherein one pixel in each row and column is ON. The ratio of components that are ON to the total number of components here is ½, so that an observer sees a color averaging 0.5 of the brightness capability of the passive color LCD display.

FIG. 3I illustrates the 17×17 matrix pattern for grey level 11. In particular, twelve pixel components are ON in each row and column for grey level 11. In each row at least one pixel component that is ON separates each of the pixel components that are OFF from one another. In addition, in every column five OFF pixel components separate two groups of pixel components that are ON, one group comprising two neighboring pixels and the other group comprising three adjacent pixels. Again, care was taken in choosing this matrix pattern to distribute the pixel components that are ON in order to produce a color for grey level 11 that is pleasing to the eye.

Therefore, the described technique produces an M×N matrix pattern having a ratio of pixel components that are ON to the total number of pixel components that achieves a particular color grey level, wherein M and N are greater or equal to two. The matrix pattern is produced on the screen for X frames, where at least one pixel component is ON in each frame.

In a preferred embodiment, the dimension of the matrix dictates the number of frames or repetitions that are displayed, which results in an even color distribution. In addition, for N frames, a matrix is produced of the same dimensions having the same number of color components ON in each row and column but in different locations from previous frames. At the end of the Nth frame, the first matrix pattern is repeated for that color grey level.

A feature of the preferred embodiments for the matrix patterns for the different grey levels is that at least one of the color components of a pixel is ON in each row and in each column for each frame. In addition, over the course of X frames each pixel component is ON for "Y" amount of times, wherein "Y" equals that number of pixel components in each row or column that is ON in any particular frame. This distribution is another factor in achieving an evenness to the color of that grey level observed on the passive color LCD display.

Further, the preferred matrix patterns for each grey level were chosen to be of different sizes from one another, and to repeat in different numbers of frames, to minimize the screen flicker that could be perceived by the human eye when viewing the passive color LCD screen. In particular, the matrix patterns were chosen to avoid frame cycles that are multiples of each other so as to minimize the impact of flicker when simultaneously viewing two or more color grey levels on the passive color LCD display.

Figure 4:
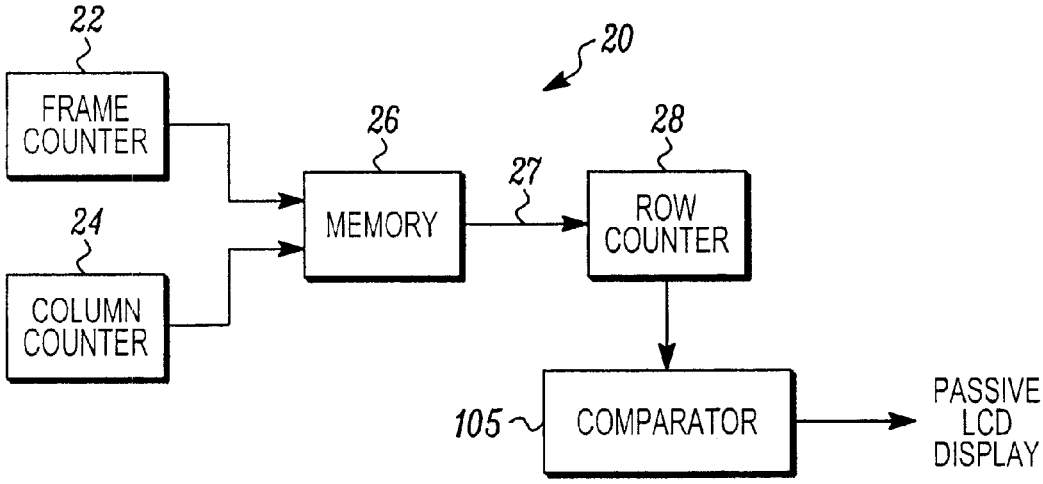
FIG. 4 is a simplified block diagram of a grey level generator circuit.

FIG. 4 is a simplified block diagram of the components of a grey level generator 20 which may comprise a portion of the frame modulator 6 of FIG. 1. In one embodiment sixteen grey level generators are provided, one for each grey level.

Referring to FIG. 4, provided are a frame counter 22 for counting the frame number, and a column counter 24 for counting the pixels in a column. The frame counter 22 and column counter 24 are connected to a memory 26 which contains a look-up table of values for a particular grey level. A row counter 28 has an output connected to a comparator 30, and is pre-loaded with an initial value for a pixel component from the look-up table in memory 26, which is based on the current frame number and column location. The comparator 30 checks the value received from the row counter 28, and then generates a signal indicating whether or not a particular color component of a pixel in a matrix pattern should be turned ON for that grey level.

For example, if the grey level 1 as shown in FIG. 3A is to be generated, the frame counter counts continuously from zero to sixteen for each frame as the screen is refreshed. Similarly, column counter 24 counts from zero to sixteen and resets at the first line of each frame. The row counter counts down the rows from sixteen to zero during data generation for the display, and is pre-loaded with an initial value from the memory 26 which includes the current frame number and the current column position. The comparator then checks the value of the row counter and, if required, generates a signal to turn ON a color component of a pixel for that coordinate. For example, referring to FIG. 3A, for frame 0 of grey level 1 a signal would be generated to turn ON the color components at row one, column fourteen and at row one, column eleven (the leftmost column in the matrix pattern of FIG. 3A being sixteen, and the rightmost column being one). This procedure continues for the other rows and columns as the passive color LCD screen is refreshed.

The grey level generator circuit 20 of FIG. 4 may be replicated sixteen times, one generator circuit for each grey level, except the counters count to different values X. For grey levels in the preferred embodiment that are complements of one another, such as grey level patterns 1 and 14, the same grey level generator circuit may be used but the complement of the comparator output would be used to turn a pixel component ON or OFF for a particular coordinate and frame.

Other embodiments are within the scope of the following claims. For example, in other embodiments different dimension matrices may be used having more or less pixel color components ON per frame. In addition, the disclosed technique may be adapted for use by other digital output devices.

What is claimed is:

1. A method for increasing the number of colors outputted by an LCD display, the method comprising the steps of:

providing a plurality of groups of pixel matrix patterns, each group of pixel matrix patterns being associated with a corresponding grey level of a plurality of grey levels, each pixel matrix pattern including a respective number of row and a respective number of columns, at least one of the respective number of rows and the respective number of columns being identical for each pixel matrix pattern within a particular group of pixel matrix patterns, but being different between groups of pixel matrix patterns that are associated with consecutive grey levels of the plurality of grey levels;

selecting one group of the plurality of groups of pixel matrix patterns to be displayed in at least a portion of the display based on a desired grey level of the plurality of grey levels to produce a selected group of pixel matrix patterns; and for each frame of a group of frames to be displayed on the LCD display, generating signals to produce a corresponding one of the pixel matrix patterns in the selected group of pixel matrix patterns, wherein each column and each row of the corresponding one of the pixel matrix patterns in the selected group of pixel matrix patterns includes an equal number of pixels that have at least one color component turned ON to achieve a particular output color over the frame.

2. The method of claim 1, wherein each pixel matrix pattern of the selected group of pixel matrix patterns has an equal number of pixels that have at least one color component turned ON and wherein locations of pixels having at least one color component turned ON are different in each pixel matrix pattern of the selected group of pixel matrix patterns.

3. The method of claim 1, wherein the number of rows equals the number of columns in each pixel matrix pattern of the selected group of pixel matrix patterns, wherein each group of pixel matrix patterns has a respective frame repeat cycle, and wherein the frame repeat cycle for the selected group of pixel matrix patterns equals the number of rows in each pixel matrix pattern of the selected group of pixel matrix patterns.

4. The method of claim 3, wherein each group of pixel matrix patterns has a respective frame repeat cycle and wherein the frame repeat cycle of the selected group of pixel matrix patterns is not a multiple of the frame repeat cycle of another group of pixel matrix patterns associated with a grey level that precedes or succeeds the desired grey level.

5. The method of claim 1, further comprising:

selecting a second group of the plurality of groups of pixel matrix patterns to be displayed in at least a portion of the LCD display based on a second grey level of the plurality of grey levels to produce a second selected group of pixel matrix patterns, wherein the respective number of columns of each pixel matrix pattern of the second selected group of pixel matrix patterns is identical within the second selected group of pixel matrix patterns, but is different than the respective number of columns of each pixel matrix pattern of the selected group of pixel matrix patterns; and for each frame of a group of frames to be displayed on the LCD display, generating signals to produce a corresponding one of the pixel matrix patterns in the second selected group of pixel matrix patterns, wherein each column and each row of the corresponding one of the pixel matrix patterns in the second selected group of pixel matrix patterns includes an equal number of pixels that have at least one color component turned ON.

6. The method of claim 1, wherein the number of pixels that have at least one color component turned ON equals the desired grey level plus one.

7. A grey level generator circuit comprising:

a plurality of pixel matrix pattern generators, each pixel matrix pattern generator of the plurality of pixel matrix pattern generators producing a respective group of pixel matrix patterns, each group of pixel matrix patterns being associated with a corresponding grey level of a plurality of grey levels, each pixel matrix pattern including a respective number of rows and a respective number of columns, at least one of the respective number of rows and the respective number of columns being identical for each pixel matrix pattern within particular group of pixel matrix patterns, but being different between groups of pixel matrix patterns that are associated with consecutive grey levels of the plurality of grey levels;

a grey level determiner for determining a desired grey level from the plurality of grey levels; and a selector for selecting one group of the plurality of groups of pixel matrix patterns to be displayed in at least a portion of an LCD display based on the desired grey level to produce a selected group of pixel matrix patterns and for generating, for each frame of a group of frames to be displayed on the LCD display, signals to produce a corresponding one of the pixel matrix patterns in the selected group of pixel matrix patterns, wherein each column and each row of the corresponding one of the pixel matrix patterns in the selected group of pixel matrix patterns includes an equal number of pixels that have at least one color component turned ON.

8. The grey level generator circuit of claim 7, wherein each of the plurality of pixel matrix pattern generators comprises:

a frame counter for counting frames to produce a frame count;

a column counter for counting pixels in a column to produce a column count;

a memory operably coupled to the frame counter and the column counter, wherein the memory includes a look-up table-of pixel color component values for a particular grey level;

a row counter that is pre-loaded with an initial pixel color component value for a pixel from the look-up table, wherein the initial pixel color component value for the pixel is based on the frame count and the column count; and a comparator operably coupled to an output of the row counter, wherein the comparator verifies a pixel color component value received from the row counter and, based on the value, generates the signals.

9. The grey level generator circuit of claim 7, wherein the grey level determiner comprises a frame buffer.

10. The grey level generator circuit of claim 7, wherein the plurality of pixel matrix pattern generators and the selector form part of a frame modulator.

* * * * *